US008646301B2

(12) United States Patent
Yokota et al.

(10) Patent No.: US 8,646,301 B2
(45) Date of Patent: Feb. 11, 2014

(54) METHOD FOR MANUFACTURING HIGH STRENGTH HOT ROLLED STEEL SHEET

(75) Inventors: Takeshi Yokota, Tokyo (JP); Kazuhiro Seto, Tokyo (JP); Satoshi Ueoka, Tokyo (JP); Nobuo Nishiura, Tokyo (JP); Yoichi Tominaga, Tokyo (JP)

(73) Assignee: JFE Steel Corporation (JP)

( * ) Notice: Subject to any disclaimer, the term of this patent is extended or adjusted under 35 U.S.C. 154(b) by 379 days.

(21) Appl. No.: 12/674,281

(22) PCT Filed: Aug. 20, 2008

(86) PCT No.: PCT/JP2008/065220

§ 371 (c)(1), (2), (4) Date: Feb. 19, 2010

(87) PCT Pub. No.: WO2009/028515

PCT Pub. Date: Mar. 5, 2009

(65) Prior Publication Data

US 2011/0271733 A1 Nov. 10, 2011

(30) Foreign Application Priority Data

Aug. 24, 2007 (JP) ..... 2007-218062

(51) Int. Cl.
*B21B 27/06* (2006.01)
*B21D 31/00* (2006.01)

(52) U.S. Cl.
USPC ..... 72/201; 72/202; 72/364

(58) Field of Classification Search
USPC ..... 72/146, 200–202, 364
See application file for complete search history.

(56) References Cited

U.S. PATENT DOCUMENTS

| | | | | | |
|---|---|---|---|---|---|
| 4,016,740 | A * | 4/1977 | Gondo et al. | ..... | 72/128 |
| 5,191,778 | A * | 3/1993 | Inagaki et al. | ..... | 72/12.2 |
| 5,558,727 | A * | 9/1996 | Miura et al. | ..... | 148/333 |
| 5,572,892 | A * | 11/1996 | Muraki et al. | ..... | 72/39 |
| 6,068,887 | A * | 5/2000 | Isobe et al. | ..... | 427/433 |
| 6,187,117 | B1 * | 2/2001 | Shen et al. | ..... | 148/654 |
| 6,855,218 | B1 * | 2/2005 | Kawalla et al. | ..... | 148/654 |
| 7,413,780 | B2 * | 8/2008 | Honda et al. | ..... | 427/433 |
| 2001/0050119 | A1 * | 12/2001 | Inoue et al. | ..... | 148/544 |
| 2002/0007882 | A1 * | 1/2002 | Inoue et al. | ..... | 148/541 |
| 2003/0196731 | A1 * | 10/2003 | Inoue et al. | ..... | 148/320 |
| 2003/0205302 | A1 * | 11/2003 | Inoue et al. | ..... | 148/541 |
| 2005/0000606 | A1 * | 1/2005 | Inoue et al. | ..... | 148/602 |

FOREIGN PATENT DOCUMENTS

| | | | |
|---|---|---|---|
| JP | 03-180426 | A | 8/1991 |
| JP | 04-088125 | A | 3/1992 |
| JP | 04-276024 | A | 10/1992 |
| JP | 04-276042 | A | 10/1992 |
| JP | 04-337026 | A | 11/1992 |
| JP | 08-176723 | A | 7/1996 |
| JP | 08-325644 | A | 12/1996 |
| JP | 2000-042621 | A | 2/2000 |
| JP | 2000-317513 | A | 11/2000 |
| JP | 2001-164322 | A | 6/2001 |
| JP | 2002-069534 | A | 3/2002 |
| JP | 2002-539330 | T | 11/2002 |

* cited by examiner

*Primary Examiner* — Dana Ross
*Assistant Examiner* — Lawrence Averick
(74) *Attorney, Agent, or Firm* — DLA Piper LLP (US)

(57) ABSTRACT

A method for manufacturing a high strength hot rolled steel sheet includes heating a slab to a temperature in the range of 1150 to 1300° C.; hot rolling the slab with a finishing rolling temperature being in the range of 800 to 1000° C.; cooling the steel sheet at a mean cooling rate of 30° C./s or higher to a cooling termination temperature in the range of 525 to 625° C.; suspending cooling for a time period in the range of 3 to 10 seconds; cooling the steel sheet in such a manner that cooling of the steel sheet is nucleate boiling; and coiling the steel sheet at a temperature in the range of 400 to 550° C.

2 Claims, No Drawings

METHOD FOR MANUFACTURING HIGH STRENGTH HOT ROLLED STEEL SHEET

RELATED APPLICATIONS

This is a §371 of International Application No. PCT/JP2008/065220, with an international filing date of Aug. 20, 2008 (WO 2009/028515 A1, published Mar. 5, 2009), which is based on Japanese Patent Application No. 2007-218062, filed Aug. 24, 2007, the subject matter of which is incorporated by reference.

TECHNICAL FIELD

This disclosure relates to a method for manufacturing a high strength hot rolled steel sheet that can be suitably used for automobile components, is excellent in terms of stretch-flangeability after working, stable in terms of localized variation of characteristics within a coil, and has a tensile strength equal to or higher than 490 MPa.

BACKGROUND

Recently, interest has been expressed in environmental issues and this situation necessitates strengthened and thinner automobile steel sheets enabling mileage improvement due to their lighter weight. Although 440 MPa grade steel is most frequently used for high strength hot rolled steel sheets today, sheets of 490 MPa or higher grade steel, in particular, 590 MPa grade steel, have been increasingly used for the reason described above. However, such strengthening also reduces ductility and stretch-flangeability, thereby posing problems such as formation of cracks in press working and a decrease in the yield.

Meanwhile, recent advancements in press technology have resulted in growth in the number of applications of working processes including drawing or stretch forming, piercing, and subsequent flange forming at sites of stretch flange deformation. Steel sheets formed by such processes will then be worked, and thus have to maintain stretch-flangeability even after piercing. However, no 490 MPa or higher grade steel sheets that support such a new working method have been developed thus far.

As a technique for improving the stretch-flangeability of unworked steel sheets, a technique wherein a slab to which Si has been added is heated at a temperature of 1200° C. or lower, hot rolled, rapidly cooled to a prescribed temperature, cooled at room temperature, and then coiled at a temperature in the range of 350 to 550° C. to produce a phase consisting mainly of bainite is disclosed in Japanese Unexamined Patent Application Publication Nos. H04-088125 and H03-180426. However, in those techniques, the temperature for heating the slab should be suppressed to prevent the formation of red scales due to the addition of Si and this would pose problems such as an increase in rolling forces and deterioration of surface characteristics. Furthermore, a phase consisting mainly of bainite would also be problematic in terms of stretch-flangeability after working.

Japanese Unexamined Patent Application Publication No. H08-325644 discloses a technique for manufacturing a steel sheet that is stable in terms of material characteristics within a coil and excellent in terms of stretch-flangeability, with an emphasis being placed on the first half of cooling, wherein cooling at a temperature of 540° C. or lower is performed as slow cooling (the cooling rate is small and in the range of 5 to 30° C./s), and cooling is performed in the film boiling region. However, cooling at a temperature of 500° C. or lower, in particular, 480° C. or lower, using film boiling necessarily leads to an increase in localized temperature unevenness that emerges in the preceding cooling steps (e.g., localized cooling due to water retention caused by defects in the shape), and as a result, localized variation of material characteristics within a coil may occur. Additionally, a slow cooling rate would promote ferrite transformation in a portion of the phase during cooling, thereby making it difficult to control the fractions of ferrite and bainite. As a result, the stretch-flangeability after working is insufficiently improved. Moreover, there would be an additional problem in terms of equipment, i.e., the line length of the cooling line has to be long.

Japanese Unexamined Patent Application Publication No. H04-276042 discloses a technique for obtaining a steel sheet with totally well-balanced strength, yield ratio, stretch-flangeability, and other characteristics, wherein a material is rolled by 70% or more in a finishing rolling step, very rapidly cooled at a rate of 120° C./s or higher, and maintained at a temperature in the range of 620 to 680° C. for 3 to 7 seconds to provide a fine ferrite phase, and then the fine ferrite phase is further cooled at a cooling rate in the range of 50 to 150° C./s and coiled at a temperature of 400 to 450° C. However, in this technique, a large pressure used in the finishing rolling step often results in surface defects and the very rapid cooling after hot rolling deteriorates the shape of a resulting steel sheet. Cooling a steel sheet having a deteriorated shape at a cooling rate of 50° C./s or higher to a temperature of 480° C. or lower would increase unevenness of cooling in some sites, thereby posing a problem of localized variation of material characteristics.

In addition, Japanese Unexamined Patent Application Publication No. 2000-042621 discloses a technique for controlling cooling of a thick steel sheet produced without a coiling step. That technique is intended to reduce the hardness difference between the surface layer and the inside of a thick steel sheet, which is caused by unevenness of cooling or other factors, by using only film boiling in the first half of cooling and using only nucleate boiling in the second half of cooling, thereby preventing the variation of material characteristics of the thick steel sheet. However, that technique is applied to a thick steel sheet having a thickness of 10 mm or larger, and thus is difficult to apply to a thin steel sheet that is produced with a coiling step and is mainly applied to have a thickness smaller than 10 mm and typically equal to or smaller than 8 mm.

Therefore, in hot rolled steel sheets (hot rolled steel bands) produced by coiling, it is difficult to eliminate the variation of material characteristics while maintaining desired characteristics merely by eliminating unevenness of cooling that occurs after hot rolling. It is thus necessary, for example, to establish a steel phase having desired characteristics while taking into consideration the component composition of the steel as well as the influences of the pattern for the cooling step performed after hot rolling and the temperature for the subsequent coiling step.

SUMMARY

We provide:

[1] A method for manufacturing a high strength hot rolled steel sheet including heating a slab to a temperature in the range of 1150 to 1300° C.; hot rolling the slab with a finishing rolling temperature in the range of 800 to 1000° C.; cooling the steel sheet at a mean cooling rate of 30° C./s or higher to a cooling termination temperature in the range of 525 to 625° C.; suspending cooling for a time period in the range of 3 to 10 seconds; cooling the steel sheet in such a manner that cooling of the steel sheet is nucleate boiling; and coiling the steel sheet at a temperature in the range of 400 to 550° C., wherein the slab contains the following elements at the following content ratios by weight percent:

C: 0.05 to 0.15%

Si: 0.1 to 1.5%

Mn: 0.5 to 2.0%

P: 0.06% or lower

S: 0.005% or lower

Al: 0.10% or lower; and

Fe and unavoidable impurities as the balance.

[2] A method for manufacturing a high strength hot rolled steel sheet including heating a slab to a temperature in the range of 1150 to 1300° C.; hot rolling the slab with a finishing rolling temperature in the range of 800 to 1000° C.; cooling the steel sheet at a mean cooling rate of 30° C./s or higher to a cooling termination temperature in the range of 525 to 625° C.; suspending cooling for a time period in the range of 3 to 10 seconds; cooling the steel sheet in such a manner that cooling of the steel sheet is nucleate boiling; and coiling the steel sheet at a temperature in the range of 400 to 550° C., wherein the slab contains the following elements at the following content ratios by weight percent:

C: 0.05 to 0.15%

Si: 0.1 to 1.5%

Mn: 0.5 to 2.0%

P: 0.06% or lower

S: 0.005% or lower

Al: 0.10% or lower;

one or more of the following elements at the following content ratios:

Ti: 0.005 to 0.1%; Nb: 0.005 to 0.1%; V: 0.005 to 0.2%; W: 0.005 to 0.2%; and

Fe and unavoidable impurities as the balance.

Our method enables manufacturing a steel sheet that follows recent changes in press working methods and is excellent in terms of the stretch-flangeability after working Furthermore, controlling the phase of the steel sheet and controlling the cooling thereof, we can prevent the emergence of localized low-temperature sites in the steel sheet, which is difficult to eliminate by known cooling methods, thereby making it possible to manufacture a steel sheet with reduced variation inside.

DETAILED DESCRIPTION

We provide a method for manufacturing a high tensile strength steel sheet (high strength steel sheet) that has strength of 490 MPa or higher, has a hole expanding ratio λ after 10% working of 80% or higher, is excellent in terms of stretch-flangeability, and stable in terms of localized variation of material characteristics within a coil. In addition, the method can be suitably used for manufacturing a hot rolled thin steel sheet typically having a thickness that is equal to or larger than 1.2 mm and is smaller than 10 mm or the like.

We intensively studied 490 MPa or higher grade steel sheets for the fractions of ferrite and bainite phases, which relate to the stretch-flangeability after working thereof. At the same time, we sought a manufacturing method that prevents localized cooling unevenness in such a steel sheet while consistently maintaining the optimum fractions of ferrite and bainite. We found that the strength of bainite itself greatly depends on the coiling temperature, more specifically, a decreased coiling temperature results in an increased strength of bainite itself and a too large fraction of bainite makes the strength of the steel sheet vary greatly in association with a change in the coiling temperature. Therefore, we studied a method for preventing an emergence of localized supercooling sites in a steel sheet during a coiling step by controlling the fractions of ferrite and bainite to reduce the coiling temperature dependence of the strength and avoiding cooling in a transition boiling region.

As a result, we found that a bainite phase can be uniformly dispersed in a ferrite phase at a volume fraction in the range of 5 to 20% by cooling a steel sheet at a mean cooling rate of 30° C./s or higher to a cooling termination temperature in the range of 525 to 625° C., suspending the cooling for a time period in the range of 3 to 10 seconds, cooling the steel sheet once again in such a manner that cooling of the steel sheet is nucleate boiling, and then coiling the steel sheet at a temperature in the range of 400 to 550° C., and that localized cooling unevenness within a coil can be prevented by performing the cooling of the steel sheet in the nucleate boiling region.

The reasons why the chemical composition of our steel sheets is selected described above is shown below.

C: 0.05 to 0.15%

C is an element required for forming bainite to ensure a necessary strength. To achieve a strength equal to or higher than 490 MPa, it is needed to use C at a content ratio of 0.05% or higher. However, the content ratio of C exceeding 0.15% would result in a large quantity of cementite in grain boundaries, thereby causing a decrease in ductility and stretch-flangeability. Preferably, the content ratio of C is in the range of 0.06 to 0.12%.

Si: 0.1 to 1.5%

Si increases the hardness of the ferrite phase via solid solution strengthening and thus reduces the phase hardness difference between the ferrite and the bainite phases, thereby improving the stretch-flangeability. Additionally, Si accelerates concentration of C into the austenite phase during the ferrite transformation to promote formation of bainite that comes after coiling. To improve the stretch-flangeability, it is necessary that the content ratio of Si is 0.1% or more. However, the content ratio of Si exceeding 1.5% would result in deterioration of surface characteristics, thereby causing deterioration of fatigue characteristics. Preferably, the content ratio of Si is in the range of 0.3 to 1.2%.

Mn: 0.5 to 2.0%

Mn is also an element effective in solid solution strengthening and formation of bainite. To achieve a strength equal to or higher than 490 MPa, it is needed to use Mn at a content ratio of 0.5% or higher. However, the content ratio of Mn exceeding 2.0% would reduce weldability and workability. Preferably, the content ratio of Mn is in the range of 0.8 to 0.18%.

P: 0.06% or lower

The content ratio of P exceeding 0.06% would cause reduction of stretch-flangeability due to segregation. Therefore, the content ratio of P should be 0.06% or lower and preferably it is 0.03% or lower. In addition, P is also an element effective in solid solution strengthening and thus the content ratio thereof is preferably 0.005% or higher to obtain this effect.

S: 0.005% or lower

S forms sulfides by binding to Mn and Ti, and thus it lowers stretch-flangeability as well as reduces effective Mn and Ti. Therefore, S is an element that should be as little as possible. The content ratio of S is preferably 0.005% or lower, and more preferably 0.003% or lower.

Al: 0.10% or lower

Al is an essential element as a material for deoxidizing steel. However, the excessive addition of Al to lead the content ratio thereof in steel to exceed 0.10% would cause deterioration of surface characteristics. Therefore, the content ratio of Al should be 0.10% or lower. Preferably, the content ratio of Al is 0.06% or lower. In addition, to ensure a sufficient deoxidizing effect, the lower limit of the content ratio of Al is preferably approximately 0.005%.

The steel material may further contain one or more of the following elements, i.e., Ti, Nb, V, and W, to increase the strength of itself:

Ti: 0.005 to 0.1%; Nb: 0.005 to 0.1%; V: 0.005 to 0.2%; W: 0.005 to 0.2%.

Ti, Nb, V, and W are elements that each bind to C to form fine deposits, thereby contributing to an increase in the strength. However, if the content ratio of any of these elements is lower than 0.005%, the amount of produced carbides is insufficient. On the other hand, if the content ratio of added Ti and/or Nb exceeds 0.1%, or if the content ratio of added V and/or W exceeds 0.2%, the formation of bainite is difficult. Preferably, the content ratio of Ti and Nb is in the range of 0.03 to 0.08% each, that of V is in the range of 0.05 to 0.15%, and that of W is in the range of 0.01 to 0.15%.

The balance of the components described above consists of Fe and unavoidable impurities. As trace elements that have no negative impact on the advantageous effect of, Cu, Ni, Cr, Sn, Pb, and Sb may be contained at a content ratio of 0.1% or lower each.

Meanwhile, the method for manufacturing a high strength hot rolled steel sheet is intended to design the steel phase of the resulting hot rolled steel sheet to contain ferrite as the main phase, and more specifically, contains a ferrite phase at a volume fraction of 80% or higher and a bainite phase at a volume fraction of 3-20%. The volume fraction of the bainite phase is at least 3% because it would be difficult to achieve strength equal to or higher than 490 MPa with the volume fraction lower than 3%. Furthermore, the strength of bainite itself is greatly affected by the coiling temperature as described earlier. If the volume fraction of the bainite phase exceeds 20%, the dependence of the strength on the hardness of the bainite phase becomes more prominent, and the coiling temperature dependence of the strength of the steel sheet itself is accordingly increased. Therefore, the volume fraction of the bainite phase should be equal to or smaller than 20%. A too large volume fraction of the bainite phase would result in increased variation of material characteristics within a coil and that between coils. Therefore, the combination of the phase control and the cooling method is very important in preventing the variation of material characteristics in a steel sheet. In addition, in the method for manufacturing a high strength hot rolled steel sheet, the balance of the bainite phase described above consists almost solely of the ferrite phase. However, phases other than the ferrite and bainite phases, such as a martensite phase and a residual γ phase, may also be contained therein at a low content ratio, more specifically, approximately less than 2%.

Next, the conditions under which our steel sheets are produced are described below.

Production of the steel sheet described above includes at least heating a slab to a temperature in the range of 1150 to 1300° C.; hot rolling the slab with a finishing rolling temperature in the range of 800 to 1000° C.; cooling the steel sheet at a mean cooling rate of 30° C./s or higher to a cooling termination temperature in the range of 525 to 625° C.; suspending cooling for a time period in the range of 3 to 10 seconds; cooling the steel sheet in such a manner that cooling of the steel sheet is nucleate boiling; and coiling the steel sheet at a temperature in the range of 400 to 550° C. The reasons for these steps are described below. Temperature for heating a slab: 1150 to 1300° C. or higher The temperature for heating a slab was set at 1150° C. or higher to reduce rolling forces and ensure favorable surface characteristics. Also, at a temperature lower than 1150° C., remelting of carbides that is necessary when Ti, Nb, V, and/or W are added would be problematically slow. On the other hand, at a temperature exceeding 1300° C., coarsened γ particles would inhibit ferrite transformation, thereby reducing ductility and stretch-flangeability. Preferably, the temperature for heating a slab is in the range of 1150 to 1280° C. Finishing rolling temperature: 800 to 1000° C.

The finishing rolling temperature lower than 800° C. would make it difficult to form isometric ferrite particles and sometimes result in two-phase rolling of the ferrite and austenite phases, thereby reducing stretch-flangeability. However, the finishing rolling temperature exceeding 1000° C. would necessitate a too long cooling line to satisfy the cooling conditions. Preferably, the finishing rolling temperature is in the range of 820 to 950° C.

Cooling after finishing rolling at a mean cooling temperature of 30° C./s or higher to a cooling termination temperature in the range of 525 to 625° C. and subsequent suspension of cooling for 3 to 10 seconds With the mean cooling temperature after finishing rolling being less than 30° C./s, ferrite transformation starting at high temperatures would make the formation of bainite difficult. A longer cooling line would also be required. Therefore, the mean cooling temperature for cooling from the finishing rolling temperature to the cooling termination temperature should be 30° C./s or higher. The upper limit of the cooling rate is not limited as far as the accuracy of the cooling termination temperature is ensured. However, considering the currently available cooling technology, the preferred cooling rate is in the range of 30 to 700° C./s.

After finishing rolling, the steel sheet should be cooled to a cooling termination temperature in the range of 525 to 625° C. and then air-cooled for a time period of 3 to 10 seconds without forced cooling. Transformation of austenite into ferrite progresses during this air-cooling step without forced cooling, and this can be used to control the ferrite fraction in the steel sheet. In addition, the remaining austenite portion, which has not transformed into ferrite during the air-cooling step, transforms into bainite in the coiling step following the rapid cooling step that comes after the air-cooling step. If the cooling termination temperature is less than 525° C., the volume fraction of bainite finally obtained after coiling exceeds 20% and such a temperature is included in the region of transition boiling from film boiling to nucleate boiling, and thus the temperature unevenness in the resulting steel sheet often occurs. Therefore, the cooling termination temperature should be 525° C. or higher, and preferably it is 530° C. or higher. However, a cooling termination temperature exceeding 625° C. would result in excessive formation of ferrite during air-cooling, thereby making it difficult to ensure that the final volume fraction of bainite is 3% or higher. Therefore, the cooling termination temperature should be 625° C. or lower, and preferably it is lower than 600° C. Meanwhile, if the cooling suspension time, or air-cooling time, is shorter than 3 seconds, ferrite transformation is insufficient and thus the volume fraction of bainite finally obtained will exceed 20%. However, if the air-cooling time exceeds 10 seconds, ferrite transformation excessively progresses and thus the volume fraction of bainite finally obtained will be less than 3%. Therefore, the air-cooling time should be in the range of 3 to 10 seconds, and preferably it is in the range of 3 to 8 seconds. In summary, more preferred conditions for the first half of cooling include cooling termination temperature of at least 530° C. and less than 600° C. and air-cooling time in the range of 3 to 8 seconds.

Air-cooling described herein means the state of suspension of cooling, i.e., suspension of forced cooling. During the air-cooling step, the cooling rate of the steel sheet is much lower than that during forced cooling and the steel sheet temperature is close to the cooling termination temperature. This promotes transformation of austenite into ferrite. However, instead of this air-cooling, any means for keeping the steel sheet temperature close to the cooling termination temperature may be used.

Details of the cooling method are described below.

Cooling after air-cooling in such a manner that cooling of the steel sheet is nucleate boiling and subsequent coiling at a temperature in the range of 400 to 550° C.

The method for the second half of cooling after resuming force cooling is the most important factor. Localized supercooling sites (sites whose temperature is lower than that of the surrounding portion) caused by water retention or other causes during the first half of cooling are carried over to the second half of cooling. In the event of transition boiling from film boiling to nucleate boiling, the lower the temperature of the site is, the faster the site is cooled; and thus temperature unevenness becomes greater. This increase in temperature unevenness is significant at a temperature of 500° C. or lower, in particular, 480° C. or lower. Although such transition boiling can be avoided by lowering the cooling rate to use film boiling for cooling, this method would fail to prevent an increase in localized temperature unevenness (e.g., localized cooling due to water retention caused by defects in the shape) that emerges in the preceding cooling steps, in cooling at a temperature of 500° C. or lower, in particular, 480° C. or lower. As a result, localized variation of material characteristics occurs within a coil. Therefore, we used cooling based on nucleate boiling rather than shift of transition boiling to lower temperatures. In cooling in the nucleate boiling region, the slope of heat flux is positive and thus the higher the temperature of the site is, the faster the site is cooled (in other words, the lower the temperature of the site is, the more slowly the site is cooled). This means that even if localized supercooling sites (unevenness of cooling) emerge before the second half of cooling, this unevenness of cooling is gradually eliminated and the variation of material characteristics in the steel sheet is accordingly reduced.

Nucleate boiling can be achieved by any known method. However, cooling at a water volume density of 2000 L/min.m$^2$ would escape the transition boiling region, thereby ensuring successful nucleate boiling. In cooling of the upper surface of a steel sheet, laminar or jet cooling is preferably used as such a cooling method because of its excellent alignment. Any kind of commonly used nozzles, such as a tube or a slit nozzle, can be used without problems.

Additionally, the flow rate of the laminar or jet for injection is preferably 4 m/s or higher. This is because the laminar or jet cooling has to give a momentum to consistently break through a liquid film formed during the cooling on the steel sheet.

Therefore, in designing of a nozzle, for example, a tube laminar, it is preferable that both of the following parameters are satisfied for stable cooling: a volume of cooling water of at least 2000 L/min.m$^2$ or preferably at least 2500 L/min.m$^2$; a flow rate of 4 m/s or higher.

On the other hand, in cooling the lower surface of a steel sheet, cooling water drops therefrom by the gravitational influence and thus cannot stay on the steel sheet and forms no liquid films. Therefore, a cooling method like spraying may be used. Even if laminar or jet cooling is used, the flow rate may be 4 m/s or lower as far as the volume of cooling water for injection is 2000 L/min.m$^2$ or more.

Additionally, regarding control of the steel phase, it is preferable that the above-described second half of cooling (cooling after air-cooling) is carried out at a cooling rate of 100° C./s or higher. This is because a cooling rate lower than 100° C./s would promote ferrite transformation during cooling, thereby making it difficult to control the fractions of the ferrite and the bainite phases.

In the method for manufacturing a high strength hot rolled steel sheet, such a cooling rate of 100° C./s or higher can be achieved by cooling a steel sheet in the nucleate boiling region as described above, and a desired steel phase can be obtained by controlling the coiling temperature as follows.

The coiling temperature (CT) influences the hardness of the bainite phase and thus has an impact on strength and stretch-flangeability after working The hardness of the bainite phase increases along with a decrease in CT. However, particularly if the coiling temperature is less than 400° C., martensite harder than bainite is formed in addition to the bainite phase, and as a result, the resulting steel sheet will be problematically hard and have reduced stretch-flangeability after working. On the other hand, if the coiling temperature exceeds 550° C., cementite is formed in grain boundaries and stretch-flangeability after working is also reduced. Therefore, the coiling temperature should be in the range of 400 to 550° C., and preferably it is in the range of 450 to 530° C. In addition, a coiling temperature not higher than 500° C. includes the region of transition boiling from film boiling to nucleate boiling and thus would often cause temperature unevenness, in particular, localized low-temperature sites, without the cooling method for ensuring nucleate boiling described above. As a result, the resulting steel sheet will often be problematically hard and have reduced stretch-flangeability after working. It should be noted that the coiling temperature is the value obtained by measuring the coiling temperature at the centers in the width direction of a steel band along with the longitudinal direction thereof and then averaging the measured coiling temperatures.

Steel can be melted by any of known usual melting methods and the melting method is not necessarily limited. For example, it is preferable that steel is molten in a converter, an electric furnace, or other furnaces and then secondary refining is conducted using a vacuum degassing furnace. As for the casting method, continuous casting is preferable in terms of productivity and product quality. Furthermore, direct rolling, in which hot rolling is performed just after casting or after heating for the purpose of keeping the temperature, may be used without reducing the advantageous effect. Moreover, the advantageous effect is not reduced by adding a heating step between rough rolling and finishing rolling, welding the rolled materials after rough rolling for continuous hot rolling, or combining heating of the rolled materials with continuous rolling. In addition, obtained steel sheets have the same characteristics in the state wherein scales adhere to the surface thereof after hot rolling (black scale state) or in the state of pickled sheets obtained by pickling after hot rolling. Temper refining may be performed in a commonly used method without any particular limitation. Hot-dip galvanization, electroplating, and chemical treatment are also allowed.

EXAMPLES

Slabs each having the chemical composition shown in Table 1 were hot rolled under hot rolling and cooling conditions shown in Table 2 to provide hot rolled sheets each having a thickness of 3.2 mm. After forced cooling subsequent to finishing rolling, the steel sheets were air-cooled during the suspension of cooling. Thereafter, the hot rolled sheets were pickled in a usual manner. In addition, a radiation thermometer that allows for two-dimensional measurement of surface temperatures of the steel sheets (NEC San-ei Instruments Ltd., model TH7800) was installed just before the coiling apparatus to detect localized temperature unevenness on the steel sheets. The hot rolled sheets were pickled in a usual manner.

It should be noted that a separate study on the cooling after air-cooling mentioned in Table 1 was conducted and the results thereof confirmed that the water volume density was equal to or higher than 2000 L/min.m$^2$ and nucleate boiling was achieved.

TABLE 1

| Steel | C | Si | Mn | P | S | Al | Ti | Nb | V | W | Remarks |
|---|---|---|---|---|---|---|---|---|---|---|---|
| A | 0.065 | 0.45 | 1.2 | 0.012 | 0.002 | 0.04 | — | — | — | — | Example of the present invention |
| B | 0.06 | 0.02 | 1.6 | 0.015 | 0.001 | 0.03 | — | 0.025 | — | — | Example of the present invention |
| C | 0.09 | 1.1 | 1.45 | 0.02 | 0.001 | 0.04 | — | — | — | — | Example of the present invention |
| D | 0.08 | 0.7 | 1.2 | 0.015 | 0.002 | 0.03 | 0.035 | — | — | — | Example of the present invention |
| E | 0.08 | 0.7 | 1.2 | 0.015 | 0.002 | 0.03 | 0.025 | — | 0.062 | — | Example of the present invention |
| F | 0.08 | 0.6 | 1.2 | 0.012 | 0.003 | 0.03 | — | — | — | 0.12 | Example of the present invention |

At a position 30 m away from the leading edge of each pickled steel sheet, three JIS 5 specimens for tensile testing (in the direction perpendicular to the rolling direction) and three specimens for hole expanding testing were sampled from three positions located in two quarters and the center in the width direction to assess the mechanical characteristics of the steel sheets. Furthermore, the stretch-flangeability after working was evaluated as the hole expanding ratio by the following method: the sampled specimens for hole expanding testing (pickled materials) were cold worked at a rolling reduction of 10%; a sheet of 130 millimeters square was cut out of each cold worked steel sheet; and the sheet was pierced to make a hole of 10 mm diameter. The hole was then pushed by a 60° conical punch from the side having no burrs, and its diameter d (mm) was measured at the time when a crack ran through the entire steel sheet. Then, the hole expanding ratio λ (%) was calculated in accordance with the following formula:

$$\lambda[\%]=((d-10)/10)\times 100.$$

Variation within a steel sheet was quantified into the percent area of localized low-temperature sites S (%) on the basis of the results of temperature measurement using the radiation thermometer, provided that any site in which the coiling temperature was lower than 400° C. was defined as a localized low-temperature site.

$$S[\%]=(\text{Area of localized low-temperature sites/Total area of the steel sheet})\times 100$$

Steel sheets with S<5% were defined as steel sheets with small variation of material characteristics. Although the threshold of S should ideally be 0%, localized supercooling sites may emerge before the second half of cooling for some reason. Therefore, "S<5%" was used to define steel sheets with small variation of material characteristics. The mechanical characteristics of the steel sheets obtained by rolling Steel C under the conditions of Experiments 4 and 5 in Table 2, which were measured in localized supercooling sites (CT <400° C.) and normal sites (CT≥400° C.), are shown in Table 3. As clearly seen in the table, even experimental conditions included in the ranges specified resulted in higher hardness and lower stretch-flangeability after working in localized supercooling sites compared to those in normal sites. On the other hand, experimental conditions excluded from the ranges specified could not prevent hardening of the steel sheets even if the coiling temperature was 400° C. or higher. Furthermore, localized supercooling sites were more severely hardened under such experimental conditions. It should also be noted that such localized cooling sites have to be cut out and discarded, thereby leading to a decrease in the yield of steel sheets.

The volume fraction of bainite was calculated by the following method: specimens for scanning electron microscopy (SEM) were sampled from the vicinity of the sites from which the specimens for tensile testing had been sampled; a cross-section of each specimen parallel to the rolling direction was polished and corroded (with Nital); and then SEM images were taken with a magnification of ×1000 (in ten regions) to visualize the bainite phase. After that, the obtained images were analyzed to measure the area of the bainite phase and the area of the observed regions, and the area fraction of bainite was accordingly calculated. This area fraction was used as the volume fraction of bainite.

The experimental results are shown in Table 2. The values of TS and λ are each the average of three measurements. In the examples shown in Table 2, the steel phase excluding the bainite phase consisted solely of the ferrite phase. As clearly seen in the table, our examples were almost free from localized low-temperature sites within a coil and excellent in terms of the stretch-flangeability after working.

TABLE 2

| Experiment No. | Steel | Heating temperature (° C.) | Finishing rolling temperature (° C.) | Mean cooling rate after finishing rolling (° C./s) | Cooling termination temperature (° C.) | Cooling termination time (air-cooling time) (s) | Cooling rate after air-cooling (° C./s) | Water volume density of cooling water after air-cooling (L/min. m$^2$) | Mode of cooling after air-cooling | Coiling temperature (° C.) | Percent area of localized low-temperature sites: S (%) | Volume fraction of the bainite phase (%) | TS (MPa) | Hole expanding ratio after working: λ (%) | Remarks |
|---|---|---|---|---|---|---|---|---|---|---|---|---|---|---|---|
| 1 | A | 1240 | 880 | 65 | 610 | 4 | 360 | 2600 | ○ | 490 | 0 | 7 | 498 | 120 | Example of the present invention |
| 2 | B | 1240 | 860 | 65 | 590 | 4 | 350 | 2600 | ○ | 480 | 0 | 6.5 | 552 | 115 | Example of the present invention |
| 3 | C | 1240 | 860 | 70 | 580 | 5 | 360 | 2600 | ○ | 480 | 0 | 7.2 | 605 | 105 | Example of the present invention |

TABLE 2-continued

| Experiment No. | Steel | Heating temperature (° C.) | Finishing rolling temperature (° C.) | Mean cooling rate after finishing rolling (° C./s) | Cooling termination temperature (° C.) | Cooling termination time (air-cooling time) (s) | Cooling rate after air-cooling (° C./s) | Water volume density of cooling water after air-cooling (L/min. $m^2$) | Mode of cooling after air-cooling | Coiling temperature (° C.) | Percent area of localized low-temperature sites: S (%) | Volume fraction of the bainite phase (%) | TS (MPa) | Hole expanding ratio after working: λ (%) | Remarks |
|---|---|---|---|---|---|---|---|---|---|---|---|---|---|---|---|
| 4 | | 1240 | 860 | 65 | 580 | 5 | 350 | 2600 | ○ | 420 | 2 | 8.2 | 612 | 98 | Example of the present invention |
| 5 | | 1240 | 870 | 70 | 510 | 4 | 350 | 2600 | ○ | 420 | 13 | 21.2 | 689 | 59 | Comparative example |
| 6 | | 1240 | 790 | 65 | 570 | 4 | 350 | 2600 | ○ | 480 | 3 | 9.5 | 641 | 69 | Comparative example |
| 7 | | 1240 | 870 | 65 | 570 | 1 | 350 | 2600 | ○ | 480 | 0 | 27.6 | 697 | 68 | Comparative example |
| 8 | | 1240 | 860 | 70 | 580 | 5 | 120 | 1000 | x | 420 | 19 | 9.3 | 671 | 66 | Comparative example |
| 9 | | 1240 | 860 | 70 | 580 | 5 | 350 | 2600 | ○ | 350 | — | 7.1 | 686 | 59 | Comparative example |
| 10 | | 1240 | 860 | 65 | 600 | 15 | 350 | 2600 | ○ | 490 | 0 | 1 | 465 | 121 | Comparative example |
| 11 | | 1240 | 880 | 25 | 590 | 4 | 320 | 2600 | ○ | 480 | 0 | 0 | 420 | 118 | Comparative example |
| 12 | D | 1250 | 890 | 60 | 560 | 4 | 350 | 2600 | ○ | 530 | 0 | 4.2 | 610 | 112 | Example of the present invention |
| 13 | | 1250 | 920 | 65 | 560 | 4 | 240 | 2100 | ○ | 490 | 0 | 5.8 | 617 | 109 | Example of the present invention |
| 14 | E | 1240 | 910 | 65 | 550 | 4 | 350 | 2600 | ○ | 520 | 0 | 4.6 | 598 | 113 | Example of the present invention |
| 15 | | 1200 | 840 | 60 | 530 | 4 | 350 | 2600 | ○ | 460 | 0 | 6.1 | 603 | 108 | Example of the present invention |
| 16 | F | 1240 | 890 | 70 | 620 | 4 | 320 | 2600 | ○ | 500 | 0 | 5.4 | 607 | 101 | Example of the present invention |

* ○: Nucleate boiling
x: Transition boiling

TABLE 3

| Experiment No. | Steel | Sheet temperature at sampling positions (° C.) | TS (MPa) | Hole expanding ratio after working: λ (%) | Remarks |
|---|---|---|---|---|---|
| 4 | C | 415 | 614 | 96 | |
| | | 380 | 677 | 68 | Localized supercooling sites |
| 5 | C | 405 | 683 | 67 | |
| | | 370 | 702 | 55 | Localized supercooling sites |

The invention claimed is:

1. A method of manufacturing a high strength hot rolled steel sheet comprising:

heating a slab to a temperature in the range of 1150 to 1300° C.;

hot rolling the slab with a finishing rolling temperature in the range of 800 to 1000° C.;

cooling the steel sheet at a mean cooling rate of 30° C/s or higher to a cooling termination temperature in the range of 525 to 625° C.;

suspending cooling for a time period in the range of 3 to 10 seconds;

after suspending cooling, cooling the steel sheet such that cooling of the steel sheet is nucleate boiling; and coiling the steel sheet at a temperature in the range of 400 to 550° C., wherein the slab contains the following elements at the following content ratios by weight percent:

C: 0.05 to 0.15%

Si: 0.1 to 1.5%

Mn: 0.5 to 2.0%

P: 0.06% or lower

S: 0.005% or lower

Al: 0.10% or lower; and

Fe and unavoidable impurities as the balance, and wherein the steel sheet contains ferrite at a volume fraction of 80% or more and bainite at a volume fraction of 3-20%.

2. A method of manufacturing a high strength hot rolled steel sheet comprising:

heating a slab to a temperature in the range of 1150 to 1300° C.;

hot rolling the slab with a finishing rolling temperature in the range of 800 to 1000° C.;

cooling the steel sheet at a mean cooling rate of 30° C/s or higher to a cooling termination temperature in the range of 525 to 625° C.;

suspending cooling for a time period in the range of 3 to 10 seconds;

after suspending cooling, cooling the steel sheet such that cooling of the steel sheet is nucleate boiling; and coiling the steel sheet at a temperature in the range of 400 to 550° C., wherein the slab contains the following elements at the following content ratios by weight percent:

C: 0.05 to 0.15%

Si: 0.1 to 1.5%

Mn: 0.5 to 2.0%

P: 0.06% or lower

S: 0.005% or lower

Al: 0.10% or lower;

one or more of the following elements at the following content ratios:

Ti: 0.005 to 0.1%; Nb: 0.005 to 0.1%; V: 0.005 to 0.2%; W: 0.005 to 0.2%; and

Fe and unavoidable impurities as the balance, and wherein the steel sheet contains ferrite at a volume fraction of 80% or more and bainite at a volume fraction of 3-20%.

* * * * *